United States Patent [19]

Schankman

[11] 4,041,880

[45] Aug. 16, 1977

[54] CONVERTIBLE POKER TABLE

[75] Inventor: Milton Schankman, Valley Stream, N.Y.

[73] Assignee: Stakmore Co., Inc., New York, N.Y.

[21] Appl. No.: 634,285

[22] Filed: Nov. 21, 1975

[51] Int. Cl.[2] ..... A47B 3/00

[52] U.S. Cl. ..... 108/112; 273/136 Z

[58] Field of Search ..... 108/112, 113, 111, 90, 108/118, 35, 130, 25, 26, 33, 50; 273/136 Z, 136 R

[56] References Cited

U.S. PATENT DOCUMENTS

| | | | |
|---|---|---|---|
| 940,283 | 11/1909 | Samuel | 273/136 Z |
| 1,510,998 | 10/1924 | Marsh | 273/136 Z |
| 1,623,877 | 4/1927 | Kjetsaa | 206/815 X |
| 2,654,647 | 10/1953 | Murray | 108/112 |
| 2,707,664 | 5/1955 | Marsilius | 108/127 |
| 2,827,352 | 3/1958 | Boyajian | 108/35 X |
| 2,934,386 | 4/1960 | Shore | 108/35 |
| 3,001,843 | 9/1961 | Davis | 273/136 Z |
| 3,049,387 | 8/1962 | Schlegel | 108/112 |
| 3,664,275 | 5/1972 | Kleinert | 108/150 |

*Primary Examiner*—James T. McCall
*Attorney, Agent, or Firm*—Roy C. Hopgood; John M. Calimafde; Charles W. Neill

[57] ABSTRACT

This disclosure relates to a poker table with two top sections that fold together for convenient storage and with two folding legs attached to each of the sections. The sections are connected together by invisible hinges and there are detachable fastening means on the sections to prevent folding when the table is set up ready for use. Chip-holding recesses in the top surface have fillers that may be used to give the table top a flush surface for use as a dining table. The preferred construction is a plastic molding for each section and a polygonal shape with the recesses and fillers corresponding to the shape of the polygon.

9 Claims, 9 Drawing Figures

CONVERTIBLE POKER TABLE

BACKGROUND AND SUMMARY OF THE INVENTION

Poker tables are ordinarily considerably larger than card tables, and even if they have folding legs, the tabletop is of such extent as to make storage of the table difficult. The chip-holding recesses of a poker table make the table unsuitable for many other uses.

This invention provides an improved poker table which has the table top in sections that are hinged together so that they fold over one another for convenient storage. The sections are connected together by invisible hinges which permit the sections to abut one another with surfaces flush when the table is set up. Fillers are provided for the chip-holding recesses and constructed in such a way that they can be conveniently inserted and removed from the recesses and to provide a flush tabletop when the fillers are in place. This makes the poker table of this invention suitable for a dining table or any other table which needs a continuous flush surface.

The construction of the table sections is such that they lend themselves to manufacture as one-piece plastic moldings.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
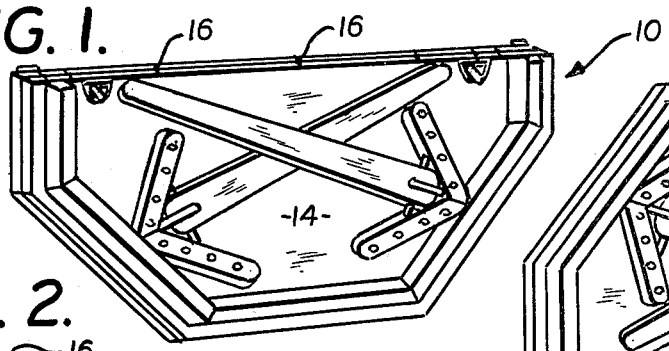
FIG. 1 is an isometric view of a table, made in accordance with this invention, and with the sections and legs of the table folded for convenient storage.
Figure 2:
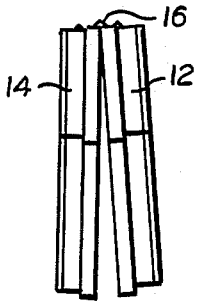
FIG. 2 is an end view of the folded table shown in FIG. 1.
Figure 9:
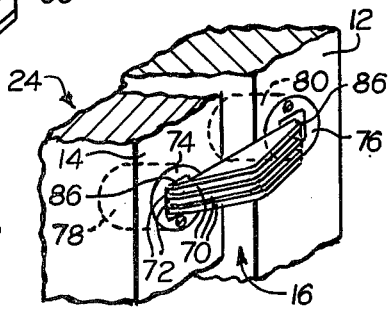
FIG. 9 is a greatly enlarged isometric, detail view showing one of the hinges for connecting the sections of the table together.

FIGS. 1 and 2 show a poker table 10 having two sections 12 and 14 connected together by hinges 16 in such a way that the sections 12 and 14 fold over one another, as shown in FIG. 2. The hinges 16 are a type of hinge commonly used for furniture and known as an "invisible hinge." The construction will be described in more detail in connection with FIG. 9, and for the present it is sufficient to understand that these hinges permit the sections 12 and 14 to be folded into positions where they form a flush tabletop with the confronting faces of the sections 12 and 14 in abutting relation with one another so that there is no gap between them when the table is in set-up condition ready for use.

Figure 3:
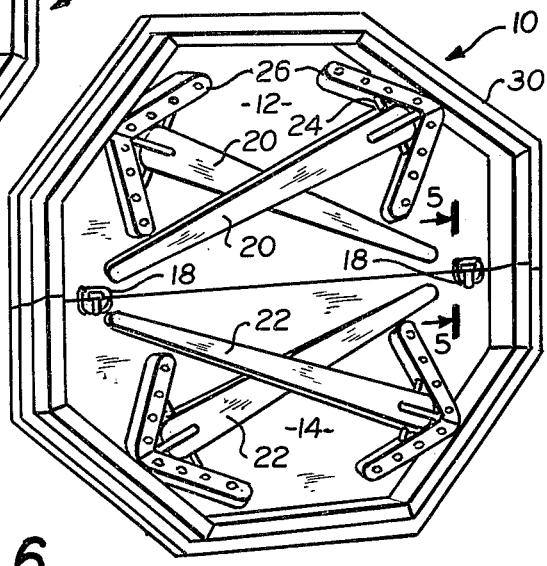
FIG. 3 is a view similar to FIG. 1, but showing the sections of the tabletop in open position and connected together to prevent folding.

FIG. 3 shows the sections 12 and 14 in their extended positions and held against folding by detachable fastening means 18, which will be explained in more detail in connection with FIGS. 4 and 5.

There are legs 20 connected with the section 12 and other legs 22 connected with the section 14. The legs 20 are connected with the section 12 by pivot connections 24 on which the legs move between folded and extended positions with respect to brackets 26 attached to the undersurface of the section 12. These brackets 26 are set in such positions that the legs 20 fold across one another, as shown in FIG. 3, when in folded condition, and the folded legs do not extend beyond the outline of the table section 12.

For more compact folding, the brackets 26 and pivot connections 24 are oriented so that neither the brackets 26 nor the legs 20, when in folded position, extend from the tabletop any further than side frames 30, which extend downwardly from the tabletop in accordance with conventional table construction. The legs 22 of section 14 are connected to that section in a manner similar to that already described for the legs 20 of the section 12.

Figure 4:
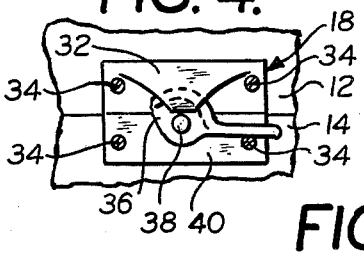
FIG. 4 is a detailed view showing the fastening means of FIG. 3, on a large scale, for holding the sections of the tabletop against folding.
Figure 5:
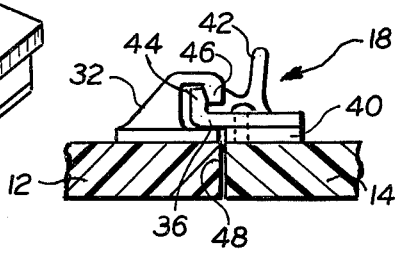
FIG. 5 is a greatly enlarged sectional view taken through the fastening means of FIG. 4 and on the line 5—5 of FIG. 3.

FIGS. 4 and 5 are greatly enlarged views of the detachable fastening means 18. A fixed lock element 32 is attached to the section 12.

A movable locking element 36 rotates about a fixed stud 38 extending upward from a plate 40 which is secured to the section 14 by screws 34 or other fastening means.

A handle 42 of the movable locking means 36 is used to rotate the locking means 36 about the stud 38, so that a raised part 44 moves in behind a downward extension 46 with a cam action that urges the fixed locking element 22 toward the movable locking element 36 in the same manner as a conventional double-hung sash window lock. This holds the confronting faces 48 firmly in contact with one another and prevents the sections 12 and 14 from swinging on their hinges and thus maintains the sections in extended positions with respect to one another, so that the top surfaces of the sections 12 and 14 (which are the lower surfaces with the sections in the orientation shown in FIG. 5) in flush relationship to one another.

Figure 6:
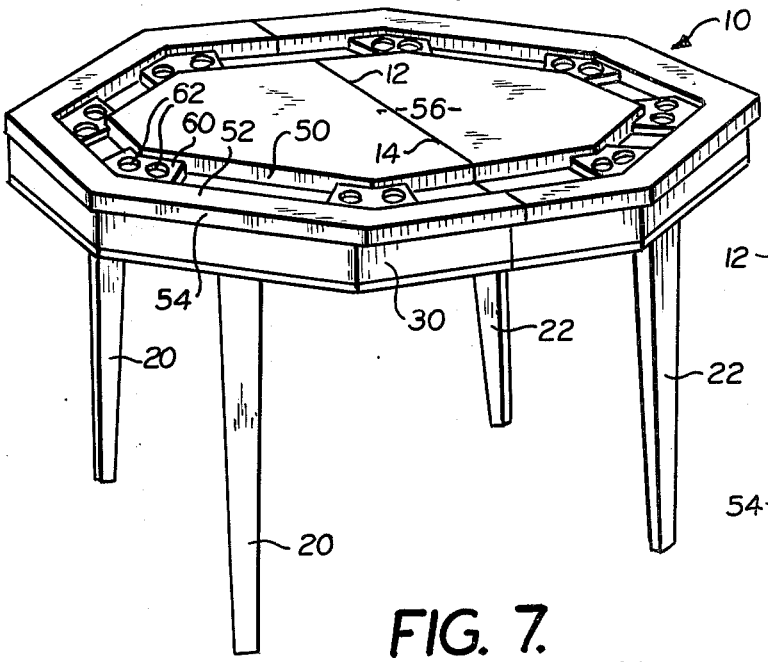
FIG. 6 is an isometric view of the table of FIGS. 1–3 with the legs unfolded and the table set up for playing poker.

FIG. 6 shows the table 10 with the legs 20 and 22 in their extended positions and the table set up ready to play poker. The preferred embodiment of the invention has a polygonal shape. The table shown in the drawing has 8 sides, but it can be made with different numbers of sides; and it can be round, if desired.

There are recesses 50 in the top of the table, and these recesses are spaced inwardly from the edges of the table, so that there is a peripheral portion 52 of the tabletop between the recesses 50 and the peripheral edge 54 of the tabletop. The peripheral portion 52 is in the same plane as the center portion of the tabletop, indicated in FIG. 6 by the reference character 56.

The recesses 50 are for holding chips. In the construction shown, each recess 50 extends for a distance corresponding to the angular extent of each side of the tabletop with respect to the center of the table; and in an eight-sided table, as shown, each side of the table corresponds to 45 degrees of angular extent.

In the construction shown in FIG. 6, there is a raised portion 60 at each end of each of the recesses 50, and these raised portions 60 are shown with smaller recesses 62.

If the table shown in FIG. 6 is to be used for purposes other than poker, for example, as a dining table, then the top surface is made flush by putting fillers into the recesses 50.

Figure 7:
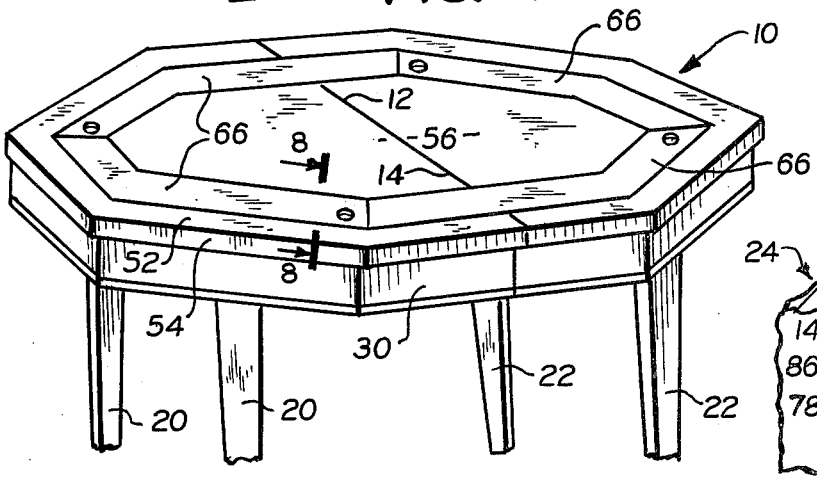
FIG. 7 is a view similar to FIG. 6, but showing the chip-holding recesses with fillers in them for making the tabletop flush across its entire area.

FIG. 6 shows the table with fillers 66 in all of the recesses 50, and the top surfaces of these fillers 66 are flush with the peripheral portion of the tabletop beyond the recesses and also with the central portion 56. Each filler 66 preferably extends for the length of two recesses and the different portions of the fillers 66 are in the same angular relation to one another as the sides of the table, so that the fillers completely cover the open part of the recesses, as shown in FIG. 7. The raised portions 60 support the fillers 66 at such a level as to bring the top surface of the filler flush with the adjacent top surface portions of the tabletop, as shown in FIG. 8.

Figure 8:
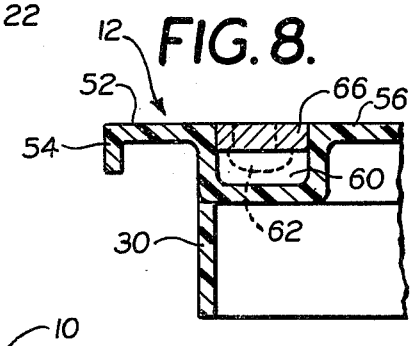
FIG. 8 is an enlarged sectional view taken on the line 8—8 of FIG. 7.

The sections 12 and 14 of the table can be made of wood or other suitable material; but they can be very economically made from plastic, and FIG. 8 shows the construction of a portion of the section 12 made as a one-piece plastic molding.

FIG. 8 shows one of the invisible hinges 16. This hinge is a well-known type of hinge for use with certain types of furniture, and it consists of a plurality of spaced and parallel plates 70 hinged to complementary parallel bracket portions 72, which extend from pistons 74 and 76, located in bores 78 and 80, respectively. The pistons 74 and 76 slide forward in the bores so that the bracket plates 72 extend beyond the faces of the tabletop sections 12 and 14. This permits the plates 70 to extend across the faces of the sections 12 and 14.

Pivot pins 86, which extend through both ends of the plates 70 and through corresponding brackets 72 on the respective pistons 74 and 76, permit the tabletop sections 12 and 14 to move angularly with respect to one another, so that the pistons 74 and 76 can slide inwardly in the bores 78 and 80 until the confronting faces of the sections 12 and 14 are in contact with one another, and one half of each of the plates 70 is housed within one of the bores 78 and 80.

The preferred embodiment of the invention has been illustrated and described, but changes and modifications can be made and some features can be used in different combinations without departing from the invention as defined in the claims.

What is claimed is:

1. A poker table including a table top having a perimeter which is a polygon with sides of substantially equal length having an even number of sides and having at least six sides, the table top comprising two sections, hinges connecting said sections together for movement between an extended position and a folded position in which the sections overlap one another for convenient storage, detachable fastening means on the sections near the hinges for preventing folding of said sections when they are in extended position forming the top of the table when set up and ready for use, four legs attached to the sections on the undersides thereof, two of the legs being attached to each section of the table and folding substantially parallel to the undersides of the respective sections of the table, and movable into positions substantially normal to the table top for supporting the table when in use, characterized by chip-holding recesses in the top surface of said sections near the peripheral edges of the table top, a plurality of fillers that fit into the upper portions of the chip-holding recesses and that provide bridging surfaces closing the upper ends of the recesses, the table top having portions outward of the recesses, the top surface of the table above the recesses and above the portions outward of the recesses being substantially flush with the top surface of the sections inward of the chip-holding recesses when the fillers are in position closing the recesses whereby the table can be used as a dining table.

2. The poker table described in claim 1 characterized by the fillers being of less depth than the recesses, and means for holding the fillers in position to make their upper surfaces flush with the adjacent surfaces of the table sections.

3. The poker table described in claim 1 characterized by each of the fillers having an opening therein for admitting a person's finger under the filler for lifting it out of the chip-holding recess.

4. The poker table described in claim 1 characterized by the upper portions of the chip-holding recesses being of sufficient angular extent to provide a continuous depression adjacent to but inward from the periphery of the table top and having a shape corresponding to the shape of the table top, and each of the fillers extending for the full angular extent of the chip-holding recess provided for each particular player, all of the fillers providing closure for the entire length of the continuous portion of the chip-holding recesses.

5. The poker table described in claim 1 characterized by the table having eight sides and four one-piece folding legs, two of the legs being attached to each section of the table and folding across one another substantially parallel to the undersides of the respective sections of the table from pivot connections located adjacent to mid-portions of alternate sides of the octagonal table top, and the line along which the sections are connected to one another extending between mid-sections of sides of the polygon other than the sides that are adjacent to the first connections on which the legs move into folded position.

6. The poker table described in claim 1 characterized by each section of the table, including the recesses therein, being a one-piece plastic molding.

7. The poker table described in claim 1 characterized by an invisible hinge connecting the sections together, and the detachable fastening means on the sections for preventing folding including a plurality of movable parts on one section and fixed elements on the other section in position to be engaged by the movable parts when the fastening means are in position for preventing folding of the sections with respect to one another.

8. The poker table described in claim 1 characterized by the table top having the recesses extending substantially parallel to the respective sides and with their ends adjoining one another so that the recesses form a continuous depression corresponding to the polygon formed by the table top, the successive recesses meeting with one another with angles corresponding to the angles of the polygon, and each filler being of a length corresponding to two sides of the polygon formed by the recesses and angularly shaped to correspond to the angle at which the recesses meet one another.

9. The poker table described in claim 8 characterized by each of the fillers being of integral construction and held against sliding movement in its recess by the angular shape of the filler corresponding to the angles of the pentagon periphery of the table top, and portions of the chip-holding recess, at locations corresponding to the angles of the polygon and at elevations above the adjacent parts of the recesses in position to support the fillers with the tops of the fillers flush with other parts of the table top.

* * * * *